US007437799B2

(12) United States Patent
Rocke

(10) Patent No.: US 7,437,799 B2
(45) Date of Patent: Oct. 21, 2008

(54) CLEANER HEAD FOR A VACUUM CLEANER

(75) Inventor: Alexander Simon David Rocke, Malmesbury (GB)

(73) Assignee: Dyson Technology Limited, Wiltshire (GB)

( * ) Notice: Subject to any disclaimer, the term of this patent is extended or adjusted under 35 U.S.C. 154(b) by 260 days.

(21) Appl. No.: 10/499,004

(22) PCT Filed: Nov. 15, 2002

(86) PCT No.: PCT/GB02/05170

§ 371 (c)(1),
(2), (4) Date: Sep. 22, 2006

(87) PCT Pub. No.: WO03/055371

PCT Pub. Date: Jul. 10, 2003

(65) Prior Publication Data

US 2007/0101537 A1 May 10, 2007

(30) Foreign Application Priority Data

Dec. 21, 2001 (GB) ..... 0130662.0

(51) Int. Cl.
*A47L 9/02* (2006.01)

(52) U.S. Cl. ..... 15/421

(58) Field of Classification Search ..... 15/415.1, 15/419, 421; *A47L 9/02*
See application file for complete search history.

(56) References Cited

U.S. PATENT DOCUMENTS 2,978,733 A 4/1961 Wahlborg
3,080,599 A * 3/1963 Wahlborg et al. ..... 15/421
6,123,779 A 9/2000 Conrad et al.

FOREIGN PATENT DOCUMENTS

| | | |
|---|---|---|
| DE | 514164 | 12/1930 |
| DE | 28 15 196 | 7/1978 |
| EP | 0 898 924 | 3/1999 |
| GB | 875332 | 8/1961 |
| JP | 04-197224 | 7/1992 |
| JP | 5211962 | 8/1993 |
| JP | 2001-218710 | 8/2001 |

* cited by examiner

*Primary Examiner*—David A Redding
(74) *Attorney, Agent, or Firm*—Morrison & Foerster LLP

(57) ABSTRACT

The invention provides a cleaner head (50;90;130;180) for a vacuum cleaner comprising a housing (52;92;132;182), a suction opening (60;100;142;184) in a face (58;96;136;186) of the housing which is intended to face a floor surface, a suction passage (110;146) for conducting dirt-laden air from the suction opening (60;100;142;184) through the cleaner head to an outlet thereof, a bleed air inlet (200) arranged in the housing and closed by a bleed valve (76;124;166;198) which is openable to allow air to be bled into the suction passage via the bleed air inlet. The cleaner head further comprises a force-transmitting member (68 122;152;194;232) connected to, or adapted to be connected to, a handle (18;48) by means of which the cleaner head is, in use, maneuvered across the floor surface, and the force-transmitting member (68;122; 152;194;232) is connected to the housing by a connection allowing relative movement between the force-transmitting member and the housing.

22 Claims, 7 Drawing Sheets

CLEANER HEAD FOR A VACUUM CLEANER

This invention relates to a cleaner head for a vacuum cleaner. The invention is suitable for use in domestic vacuum cleaners of either the upright type or the cylinder type.

Vacuum cleaner manufacturers often provide potential customers with a measure of the "airwatts" developed by their products. This is a measure of the amount of suction provided at the suction opening of the appliance through which dirty air and debris is sucked. In upright vacuum cleaners, the suction opening is normally provided in a cleaner head mounted directly on a main body or motor casing of the cleaner. In cylinder cleaners, the suction opening is provided in a cleaner head formed by a floor tool connected to the main body via a hose and wand assembly. One disadvantage of providing a high measure of airwatts at the suction opening is that the cleaner head can be sucked onto the surface to be cleaned to such an extent that little or no air can enter the suction opening from outside the vacuum cleaner. This results in a reduction of the efficiency of the cleaner because an airflow is required to pass through the cleaner in order to transport dirt and dust from the suction opening to the separation apparatus by means of which the dirt-laden air is cleaned. Another detrimental effect is that the cleaner head can become "stuck" to the surface to be cleaned and is then difficult to move across the surface to be cleaned.

It is also the case that some floor coverings have characteristics which result in high friction forces being developed between them and the cleaner head irrespective of the airflow passing through the cleaner head. Comparatively high push forces are then required to maneuver the cleaner head over these surfaces, thus making normal use of a vacuum cleaner difficult.

It is known to provide a bleed valve to allow additional air to be bled into the vacuum cleaner in order to vary the amount of suction developed at the suction opening and so to allow the operation of the vacuum cleaner deliberately to be adjusted in response to varying operating conditions. Providing additional airflow through the vacuum cleaner reduces the suction developed at the suction opening and thus reduces the force with which the cleaner head is sucked onto the surface. Reducing this force thus reduces the force required to maneuver the cleaner head over the surface to be cleaned. Also, providing additional airflow restores the capability of the airflow passing through the vacuum cleaner to transport dirt and dust from the bleed valve to the separation apparatus so that the vacuum cleaner can carry out its intended purpose.

A vacuum cleaner incorporating a bleed valve is described in U.S. Pat. No. 2,978,733. This document illustrates a bleed valve situated in the handle portion of a cylinder vacuum cleaner. The arrangement is such that the bleed valve is normally open but when the cleaner head is moved in a forward direction, the size of the valve opening is reduced thus increasing the amount of suction developed at the suction opening. When the cleaner head is moved in a rearward direction, the size of the valve opening is increased so as to reduce the suction developed at the suction opening. The effect of this is to increase the force with which the cleaner head is sucked down onto the surface to be cleaned when the cleaner head is moved forwards which makes the cleaner head more difficult to move forwards across the surface. Also, the positioning of the bleed valve in the handle of the wand means that the introduction of supplementary air has no beneficial effect on the ability of the cleaner to transport dirt and dust from the suction opening to the separation apparatus since the airflow is not supplemented in the vicinity of the suction opening.

A different arrangement is illustrated in JP 5 211 962, again relating to a cylinder cleaner. Various embodiments are illustrated but they all allow additional air to be admitted into the cleaner head when the cleaner head is moved in a forward direction. This is achieved in some embodiments by raising the leading edge of the cleaner head slightly when the cleaner head is moved in a forward direction, and in other embodiments by arranging for a bleed inlet to open when the cleaner head is similarly moved forwards. When this happens, supplementary air is allowed to enter the cleaner head and this will improve the capability of the cleaner to transport dirt and dust from the cleaner head to the separation apparatus. The effort required to maneuver the cleaner head across the floor in a forward direction will also be reduced when the bleed valve is opened but this effect is not achieved until after the cleaner head has first been moved from its rest position. Thus the force required to move the cleaner head from the rest position is not reduced by the disclosed arrangement. It is also worth noting that the bleeding of additional air into the cleaner head is deliberately prevented when the cleaner head is moved in a rearward direction. Thus, when the cleaner head of this disclosure is moved in a rearward direction, there is a higher probability that the cleaner head will become "stuck" to the surface to be cleaned and the efficiency of the cleaner will be reduced.

A third known arrangement is illustrated in EP 0 898 924A. In this arrangement, the suction opening itself is made adjustable so that, on smooth floors, the suction opening is relatively small but, when the cleaner is used on deep-pile velour carpets, the trailing edge of the suction opening is moved against the action of a spring to increase the size of the opening. This can be made to occur when the cleaner head is travelling either forwards or backwards and has the effect of reducing the amount of "suck" with which the cleaner head is stuck to the floor as well as improving the efficiency of the cleaner. As with the disclosure of JP 5 211 962, this arrangement can only be made to operate when the cleaner head is actually moved across a surface to be cleaned. In both cases, this has the disadvantage that, when the amount of suction developed at the suction opening is high, the user must overcome the force causing the cleaner head to stick to the surface to be cleaned before the supplementary air can be bled into the cleaner head. Hence the force required to initiate movement of the cleaner head across the surface to be cleaned is not reduced by means of the known arrangements.

It is also known to provide bleed valves which respond automatically to an increase in the suction pressure developed in the cleaner head, which is normally indicative of a situation in which the cleaner head is stuck to the floor. Examples of this type of bleed valve are shown in GB 875332 and JP2001218710 in which pressure sensors are used to open the respective bleed valves. Such arrangements can assist in situations wherein the airflow is prevented from entering the cleaner head but they cannot provide relief when the floor covering is of a type which generates large friction forces between itself and the cleaner head.

It is an object of the present invention to provide an improved cleaner head for a vacuum cleaner. It is another object of the invention to provide a cleaner head for a vacuum cleaner in which the amount of force needed to move the cleaner head either forwards or backwards across a surface to be cleaned can be reduced without first requiring physical movement of the cleaner head across the surface. It is a further object of the invention to provide a cleaner head for a vacuum cleaner in which the amount of force required to move the cleaner head across a surface to be cleaned has an upper limit.

The invention provides a cleaner head for a vacuum cleaner comprising a housing, a suction opening in a face of the housing which is intended to face a floor surface, a suction passage for conducting dirt-laden air from the suction opening through the cleaner head to an outlet thereof, a bleed air inlet arranged in the housing and closed by a bleed valve which is openable to allow air to be bled into the suction passage via the bleed air inlet, wherein the cleaner head further comprises a force-transmitting member connected to, or adapted to be connected to, a handle by means of which the cleaner head is, in use, maneuvered across the floor surface, and the force-transmitting member is connected to the housing by a connection allowing relative movement between the force-transmitting member and the housing.

In the claimed arrangement, the bleed valve is opened when more than a predetermined amount of force is required to move the cleaner head across the floor. However, no physical movement of the cleaner head is required in order to cause the bleed valve to open. The relative movement between the force-transmitting member and the housing can be used to cause the bleed valve to open so that physical movement of the cleaner head across the surface to be cleaned is not a prerequisite for the operation of the bleed valve. Hence there is no need to overcome the force by which the cleaner head is "stuck" to the floor in order to activate the bleed valve which, in turn, will allow the suction developed at the suction opening to be reduced. This makes the operation of the vacuum cleaner, particularly the maneuverability of the cleaner head, much easier for the user when faced with conditions in which the cleaner head becomes "stuck" to the surface to be cleaned. In a preferred embodiment, the bleed valve is opened irrespective of the direction of movement of the cleaner head so that the operation of the vacuum cleaner is made easier for the user when the cleaner head is being moved both forwards and backwards.

In a further preferred embodiment, the bleed valve does not open until the amount of relative movement between the force-transmitting member and the housing has exceeded a predetermined value so as to maintain a predetermined level of suction at the suction opening. In another preferred embodiment, the bleed valve is adapted to open by an amount which is dependent upon the amount of relative movement between the force-transmitting member and the housing. In this way, the amount of air bled into the suction passage is automatically increased when the force required to move the cleaner head across the surface to be cleaned is high. The amount of suction developed at the suction opening is thus progressively decreased as the amount of relative movement is increased. Eventually a point is reached at which the suction force causing the cleaner head to "stick" to the surface is overcome by the user applying an acceptable amount of force. This perceived decrease in the amount of force required to move the cleaner head over the surface to be cleaned is advantageous to the user.

It is preferred that the amount of air bled into the suction passage is the same when a particular force is required to move the cleaner head across the floor surface in either a forward direction or a rearward direction. This results in the vacuum cleaner being equally easy to maneuver when the cleaner head is moved in both the forward and rearward directions.

It is preferred that the bleed air inlet is located on a forward facing surface of the housing and adjacent the face of the housing which is intended to face the floor surface. This ensures that the bled air enters the cleaner head close to the suction opening so that the capability of the vacuum cleaner to carry entrained dirt and dust particles from the suction opening to the separation apparatus is maintained as far as possible. Also, this location of the bleed air inlet allows dirt and dust to enter the cleaner head through the bleed air inlet in the event that the cleaner head is used adjacent a wall or other obstacle which prevents the suction opening from passing freely over a specific area of the surface to be cleaned. Alternatively, the bleed air inlet can be located on the upper surface of the housing.

Embodiments of the present invention will now be described with reference to the accompanying drawings, wherein:

FIG. 1*a* is a side view of a known vacuum cleaner of the upright type;

FIG. 1*b* is a side view of the vacuum cleaner of FIG. 1*a* shown in an operational position;

FIG. 2 is a perspective view of a known vacuum cleaner of the cylinder type;

FIG. 3*a* is a schematic sectional side view of a first embodiment of a cleaner head according to the invention and particularly suitable for use with cylinder type cleaners;

FIGS. 3*b* and 3*c* are views similar to FIG. 3*a* and illustrating the operation of the cleaner head shown therein;

Figure 1B:
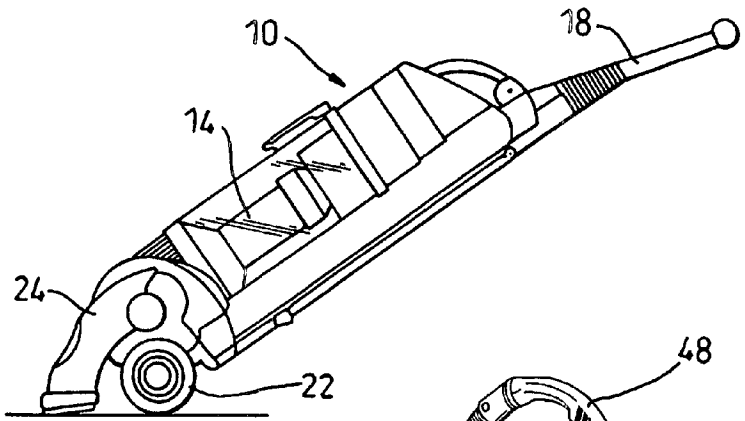
Figure 1A:
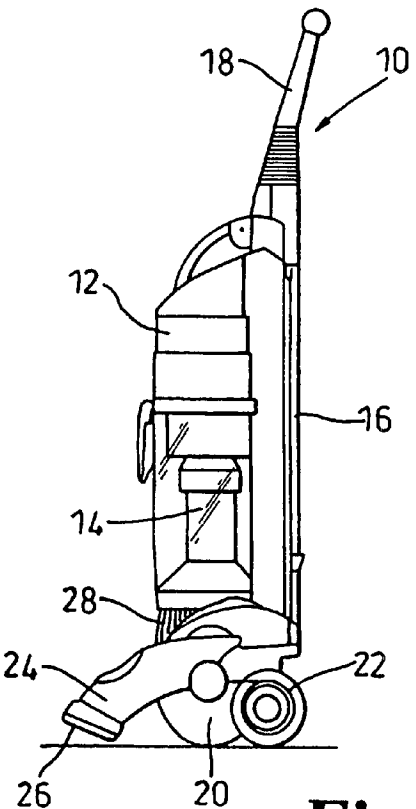

A known upright vacuum cleaner 10 is illustrated in FIGS. 1*a* and 1*b*. The vacuum cleaner 10 includes a main body 12 containing apparatus 14 for separating dirt and dust from an airflow passing through the vacuum cleaner 10. In the illustrated vacuum cleaner 10, the apparatus 14 is cyclonic in nature, but it will be appreciated that separation can be effected by other means, for example by a filtration bag.

The main body 12 is supported on the vacuum cleaner 10 by an upstanding support 16 incorporating a handle 18 located and arranged so as to enable a user of the vacuum cleaner 10 to manoeuvre the vacuum cleaner 10 across a surface to be cleaned. The handle 18 can be made releasable to form a hose and wand assembly (not shown) so as to allow the user of the vacuum cleaner 10 to carry out above-the-floor cleaning. The means by which this can be achieved is not relevant to the present invention.

A motor casing 20 is located beneath the main body 12 and houses a motor and fan unit for drawing dirt-laden air into the vacuum cleaner 10. Wheels 22 are mounted on the motor casing 20 for allowing the vacuum cleaner to be manoeuvred across a surface to be cleaned. A cleaner head 24 is rotatably mounted on the motor casing 20 so that, when the vacuum cleaner 10 is used in an upright mode as illustrated in FIG. 1*b*, the cleaner head 24 is maintained in contact with the surface to be cleaned. The cleaner head 24 also incorporates a suction opening 26 which is located in a surface of the cleaner head 24 facing the surface to be cleaned.

Conduits (not shown) are provided within the vacuum cleaner 10 in order to allow an airflow to pass from the suction opening 26 to the apparatus 14 in the main body 12 and from there to the motor casing 20 before exiting via an outlet 28. The conduits can be arranged to cause the airflow to pass through one or more filters (not shown) arranged in the vicinity of the motor. In operation, the motor draws dirt-laden air into the cleaner head 24 via the suction opening 26. The dirt-laden air is then passed to the apparatus 14 wherein dirt and dust particles entrained in the airflow are separated therefrom and collected. The cleaned air is then drawn through the fan and past the motor in the motor casing 20 so as to effect cooling before being expelled through the outlet 28. As is well known, an upright vacuum cleaner of the type illustrated in FIGS. 1*a* and 1*b* is operated by tilting the main body 12 rearwardly with respect to the cleaner head 24. The user grasps the handle 18 and applies pushing and pulling forces to the handle 18 so as to manoeuvre the cleaner head 24 over a surface to be cleaned, normally in a reciprocating manner.

Figure 2:
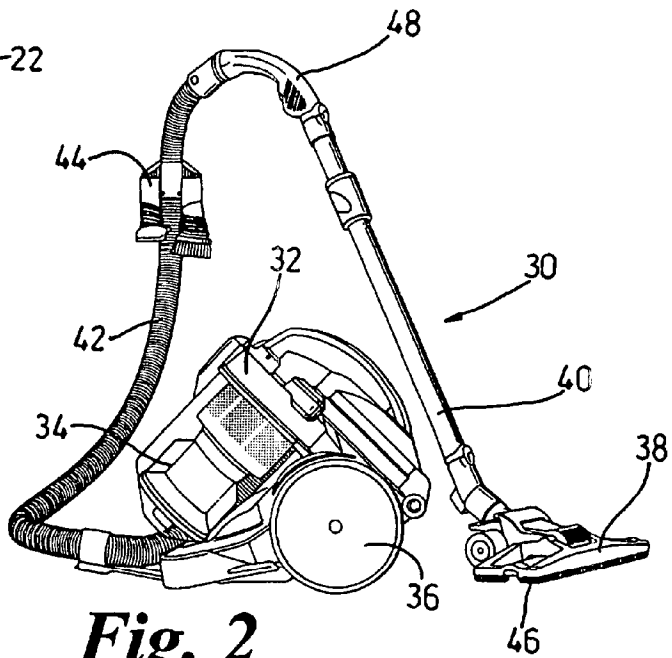

A known cylinder type vacuum cleaner 30 is illustrated in FIG. 2. The cylinder cleaner 30 comprises a main body 32 which incorporates apparatus 34 for separating dirt and dust from an airflow passing therethrough. The main body 32 has wheels 36 mounted thereon to allow the main body 32 to travel over a surface to be cleaned. A cleaner head 38 is connected to the main body 32 via a wand 40, in the form of a hollow pipe, and a flexible hose 42. The wand 40 can be rigid or telescopic and a tool holder 44 can be provided on the hose 42 for the purpose of storing accessories such as brush tools, crevice tools etc.

The cleaner head 38 includes a suction opening 46 which communicates directly with the wand 40. The wand 40 communicates with the hose 42 which, in turn, communicates with the apparatus 34. The outlet of the apparatus 34 communicates with a motor casing (not shown) in which is housed a motor and fan unit. In use, the motor and fan unit operates to draw dirt-laden air into the cleaner head 38 via the suction opening 46. The dirt-laden air passes from the cleaner head 38 to the wand 40 and then to the hose 42. The dirt is separated from the airflow in the apparatus 34, which can be a cyclonic separator or a bag filter, and then passes from the apparatus 34 to the motor casing for the purpose of cooling the motor. The air is then expelled from the vacuum cleaner 10 via a suitable outlet (not shown). Once again, filters can be provided in the vicinity of the motor, upstream thereof, downstream thereof, or both.

In use, the user of the cylinder cleaner 30 grasps the upper end of the wand 40, formed as a handgrip 48, and moves the cleaner head 38 across the surface to be cleaned. Normally, the user manoeuvres the cleaner head 38 in a reciprocating movement, ie forwards and backwards, across the surface. Dirt-laden air is sucked into the cleaner head 38 via the suction opening and passed to the apparatus 34 where separation is effected.

The above explanations relate to known vacuum cleaners. Details of the separation apparatus, airflow passages and other parts of the vacuum cleaners not related to the cleaner head do not form part of the present invention. The present invention is concerned solely with the arrangement of the cleaner head and its connection to the remainder of the vacuum cleaner.

As has been mentioned in the introduction, many manufacturers of vacuum cleaners provide customers with an indication of the "airwatts" developed by the vacuum cleaner in question. The higher the measure of airwatts, the higher the amount of suction developed at the suction opening. There is a common perception that a vacuum cleaner developing a high number of airwatts performs better than a vacuum cleaner developing a lower number of airwatts. This has encouraged manufacturers to manufacture vacuum cleaners in which the measure of airwatts is as high as possible. However, when the suction developed at the suction opening is excessive, the cleaner head of the vacuum cleaner can become very difficult to manoeuvre across the surface to be cleaned. Effectively, the cleaner head becomes "stuck" to the surface to be cleaned. The object of the present invention is to provide a cleaner head which is capable of developing very high airwatts at the suction opening but which does not require an excessive amount of force to manoeuvre it across the surface to be cleaned. Effectively, the aim is to limit the force with which the cleaner head can become "stuck" to the floor.

Figure 3A:
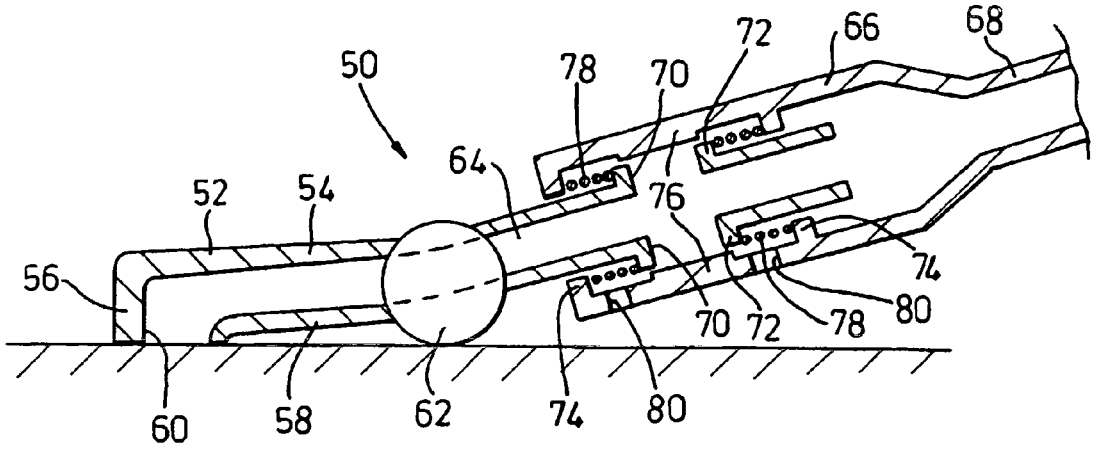

A first embodiment of a cleaner head according to the invention is illustrated schematically in FIG. 3*a*. This cleaner head 50 is designed primarily (but not exclusively) for use with a cylinder cleaner of the type illustrated in FIG. 2. The cleaner head 50 includes a housing 52 having an upper surface 54, a forward surface 56 and a lower surface 58. A suction opening 60 is formed in the lower surface 58 and wheels 62 are rotatably mounted on the housing 52. The housing 52 has considerable breadth in the area forward of the wheels 62, similar to the cleaner head 38 illustrated in FIG. 2. Rearwardly of the wheels 62, the housing 52 constricts towards a rear tubular member 64 which is surrounded by a sleeve 66. The sleeve 66 is connected in a sliding manner to the tubular member 64 and incorporates a free end 68 which is adapted to be connected to one end of the wand 40 of the vacuum cleaner 30 in relation to which the cleaner head 50 is to be used.

The tubular member 64 includes two diametrically opposed apertures 70 extending radially outwardly through the wall of the tubular member 64. Each aperture 70 is surrounded by an outwardly extending lip 72. Mounted on the sleeve 66 are two annular inwardly extending lips 74. These lips are located so as to be spaced apart from the outwardly extending lips 72 in the longitudinal direction of the tubular member 64. Thus, a first of the inwardly extending annular lips 74 is located on the side of the outwardly extending lips 72 closest to the wheels 62 and the second inwardly extending annular lip 74 is spaced from the outwardly extending lips 72 on the side thereof closest to the free end 68 of the sleeve 66.

Located on the sleeve 66 between the annular lips 74 are two inwardly extending circular bleed valves 76. These bleed valves 76 are adapted and located so as to be capable of closing the apertures 70 when the sleeve 66 is in the correct location relative to the tubular member 64. Two helical compression springs 78 are located about the tubular member 64 with their ends seated against the outwardly extending lips 72 and the annular inwardly extending lips 74 respectively. In this way, the sleeve 66 is urged by the compression springs 78 into the position, relative to the tubular member 64, in which the bleed valves 76 close the apertures 70.

Two apertures 80 are provided in the sleeve 66 between the inwardly extending annular lips 74. These apertures 80 form an outlet from the annular chamber formed within the sleeve 66 and atmosphere.

Figure 3B:
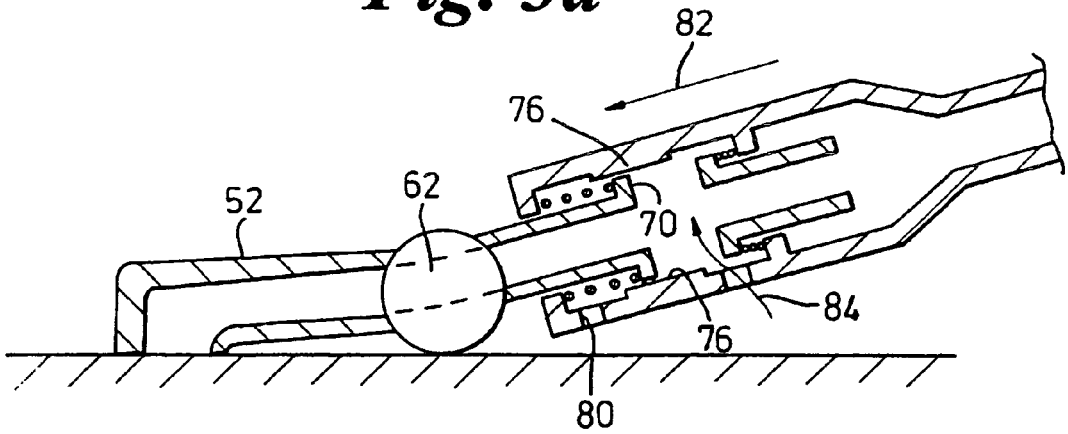

It will be appreciated that the sleeve 66 is able to move telescopically with respect to the tubular member 64. If a force is applied to the sleeve 66 in the direction of arrow 82 as shown in FIG. 3*b*, then the sleeve 66 will move axially along the tubular member 64 to the position shown in FIG. 3*b*. In this position the apertures 70 are no longer completely covered by the bleed valves 76 and air is able to enter the cleaner head 50 via the apertures 80 and 70 as indicated by arrow 84. However, the movement of the sleeve 66 with respect to the tubular member 64 is opposed by the action of the compression springs 78 so that, should the force applied in the direction of arrow 82 be removed or reduced, the sleeve 66 will move back towards the position shown in FIG. 3*a*.

Figure 3C:
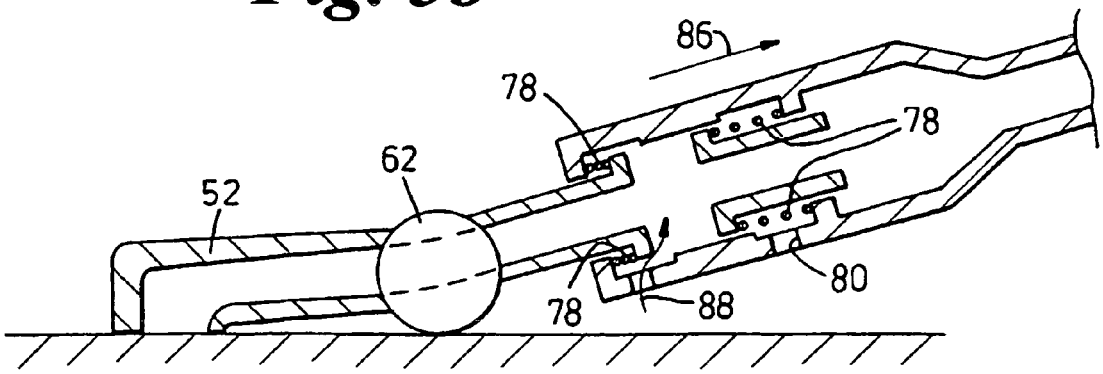

If a force is applied to the sleeve 66 in the direction of arrow 86 shown in FIG. 3*c*, then the sleeve 66 will move to the position shown in FIG. 3*c*. Once again, the apertures 70 will cease to be closed by the bleed valves 76 so that air can be bled into the cleaner head 50 via apertures 80 and 70 as indicated by arrow 88. Again, this movement is opposed by the action of the compression springs 78 so that, if the force applied is either reduced or removed, then the sleeve 66 will move back towards the position illustrated in FIG. 3*a*.

It will be appreciated that, when the cleaner head 50 is connected in any suitable manner to the lower end of a wand 40 as illustrated in FIG. 2, then the forces referred to above correspond to the forces applied by a user in order to manoeuvre the cleaner head 50 across a surface to be cleaned. In the event that the suction developed at the suction opening 60 is sufficiently high to cause the cleaner head 50 to become "stuck" to the surface to be cleaned, then the application of a force to move the cleaner head either forwards or backwards will cause relative movement between the sleeve 66 and the tubular member 64. In this event, the bleed valves 76 will move away from the apertures 70, thus allowing air to be bled into the cleaner head 50 via the apertures 80, 70. Allowing air to be bled into the cleaner head 50 in this manner has the effect of reducing the suction developed at the suction opening 60 so that the cleaner head 50 becomes easier to move. In the event that the suction developed at the suction opening 60 is not reduced sufficiently to allow the user to move the cleaner head 50 across the surface to be cleaned without the application of additional force, then further relative movement will occur between the sleeve 66 and the tubular member 64, thus allowing additional air to be bled into the cleaner head 50 via the apertures 80, 70. The bleeding of further air into the cleaner head 50 further reduces the suction developed at the suction opening 60 and, eventually, the suction force causing the cleaner head to be "stuck" to the surface to be cleaned will be reduced sufficiently to allow the cleaner head 50 to be moved.

As can be seen, it is immaterial whether the user of the vacuum cleaner 10 seeks to move the cleaner head 50 forwards or backwards across the surface to be cleaned. Relative movement between the tubular member 64 and the sleeve 66 in either direction is sufficient to cause air to be bled into the cleaner head 50 so as to produce the desired effect of reducing the suction at the suction opening 60. This in turn makes it much easier to move the cleaner head 50 across the floor.

It will also be appreciated that the biasing force of the springs 78 must be overcome before any relative movement between the tubular member 64 and the sleeve 66 can take place. By providing springs 78 with a high spring constant, the force applied by the user must be relatively high before the bleed valves will open. It will also be apparent that, by providing springs with different spring constants on each side of the apertures 70, different amounts of force can be required to overcome the biasing force of the springs in different directions. Thus, if desired, the spring 78 closest to the wheels 62 can be provided with a higher spring constant than the spring 78 remote from the wheels. Thus a higher amount of force will then be required to overcome the biasing force when the cleaner head 50 is to be moved forwards than backwards.

In a variation of the embodiment shown in FIGS. 3*a*, 3*b* and 3*c*, the variation not being illustrated specifically, the sleeve 66 is arranged on the tubular member 64 so as to be able to rotate about the axis of the tubular member 64 with respect thereto. In this case, the compression springs 78 are replaced by torsion springs so that, when the sleeve 66 is rotated with respect to the tubular member 64, the sleeve 66 is urged back towards the position shown in FIG. 3*a* against the action of the springs 78. This embodiment allows the suction force developed at the suction opening 60 to be reduced when a twisting action is applied to the wand to which the cleaner head 50 is attached. As has been described above, the higher the force required to move the cleaner head 50 across the surface to be cleaned, the greater the amount of air which is bled into the cleaner head 50.

Figure 4:
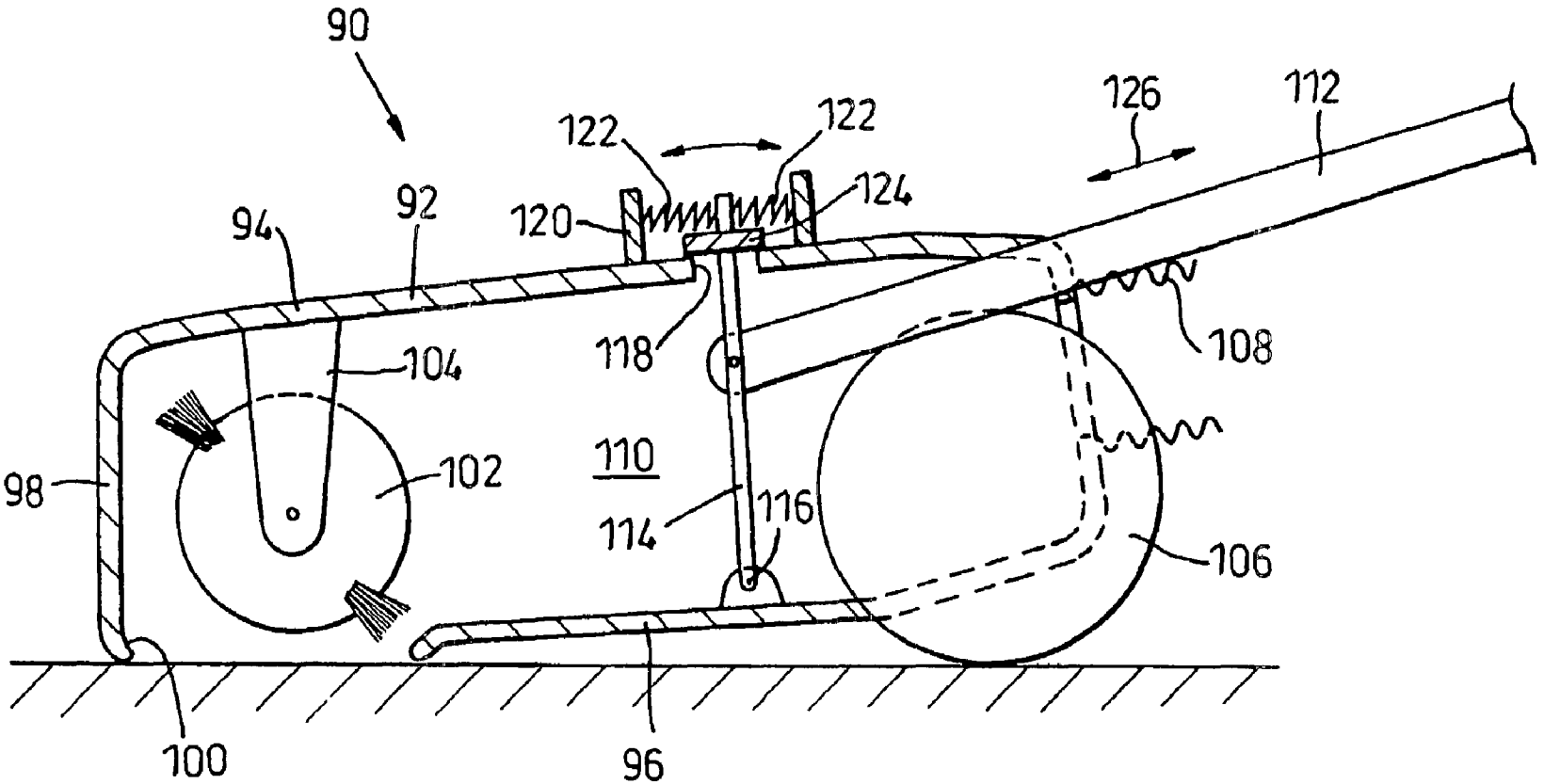
FIG. 4 is a schematic sectional side view of a second embodiment of a cleaner head according to the invention.

An alternative arrangement of cleaner head is illustrated in FIG. 4. In this arrangement, the cleaner head 90 is intended to be used in connection with an upright cleaner, although use with a cylinder cleaner is not ruled out. The cleaner head 90 incorporates a housing 92 which has an upper surface 94, a lower surface 96 and a forward surface 98. A suction opening 100 is formed in the lower surface 96 adjacent the forward surface 98. A rotatable brush bar 102 is mounted on the housing 92 via support arms 104 so that the brush bar 102 is located in the suction opening 100, as is known. Means (not shown) may be provided for actively rotating the brush bar 102.

Wheels 106 are mounted on the housing 92 to facilitate manoeuvrability of the cleaner head 90 across a surface to be cleaned. Also, a hose 108 or other conduit is provided on the housing 92 to allow dirt-laden air to be carried away from the cleaner head 90 to the apparatus 14 in which the dirt and dust will be separated from the airflow. The housing 92 delimits a suction passage 110 for carrying dirt and dust-laden air from the suction opening 100 to the hose 108.

A force-transmitting member 112 provides a connection between the cleaner head 90 and the remainder of the vacuum cleaner to which the cleaner head 90 is connected. The force-transmitting member 112 can be connected to the main body 12 or the motor casing 20 of a vacuum cleaner 10 of the type illustrated in FIG. 1*a*. Suitable connection means (not shown) may be provided at the free end of the force-transmitting member 112. The other end of the force-transmitting member 112 is pivotably connected to a rod 114 whose lower end is pivotably connected by a connection 116 to the lower surface 96 of the housing 92. The upper end of the rod 114 passes through an aperture 118 in the upper surface 94 of the housing 92. The aperture 118 is surrounded by an upstanding wall 120 projecting upwardly from the upper surface 94 of the housing 92. Two opposed compression springs 122 are located between the upper end of the rod 114 and the wall 120. A bleed valve 124 is carried by the rod 114 immediately beneath the compression springs 122.

In the event that no force is applied to the force-transmitting member 112, the action of the compression springs 122 causes the rod 114 to be positioned so that the bleed valve 124 closes the aperture 118. However, if a force is applied to the force-transmitting member 112 in either direction of the double-headed arrow 126, then the rod 114 will be forced to rotate about the connection 116. This in turn will cause the bleed valve 124 to move away from the position illustrated in FIG. 4 so that the aperture 118 will be opened, at least in part. In this event, air from outside the cleaner head 90 is able to pass into the suction passage 110 via the aperture 118.

It will be appreciated that, when the cleaner head 90 is used in connection with a vacuum cleaner, the cleaner head 90 may become "stuck" to the surface to be cleaned if an excessive amount of suction is developed at the suction opening 100. When the user of the vacuum cleaner 90 applies a force to the handle 18 (see FIG. 1*b*) in an attempt to manoeuvre the vacuum cleaner over the surface to be cleaned, and if the force applied is insufficient to overcome the suction force causing the cleaner head 90 to stick to the surface to be cleaned, then relative movement between the cleaner head casing 92 and the force-transmitting member 112 will allow air to be bled into the suction passage 110 via the aperture 118. This will reduce the amount of suction developed at the suction opening 100 and allow the cleaner head to be moved across the surface to be cleaned. It is to be appreciated that, in order to allow air to be bled into the suction passage 100, it is not necessary to overcome the suction force causing the cleaner head 90 to become "stuck" to the surface to be cleaned.

Figure 5:
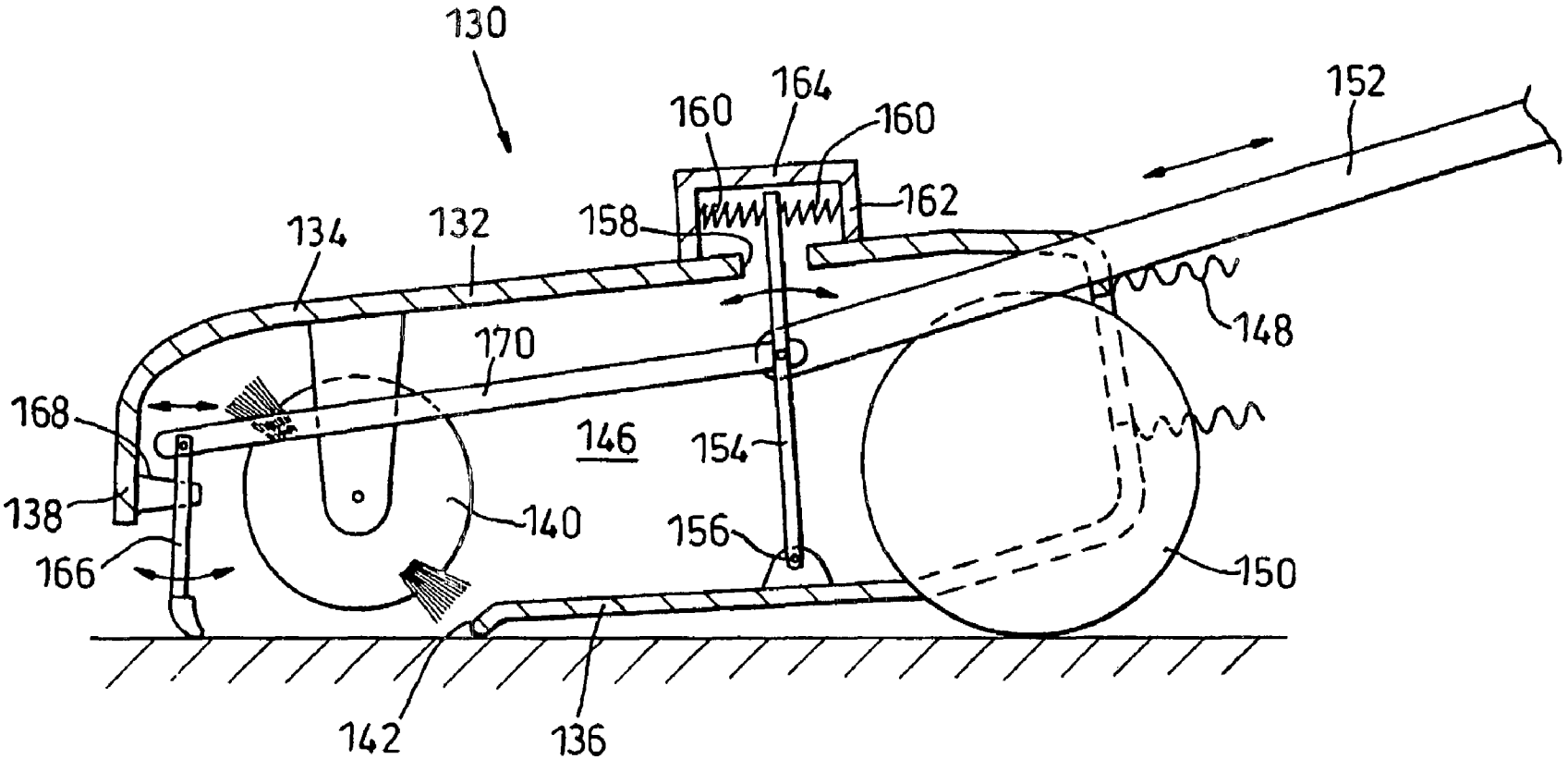
FIG. 5 is a schematic sectional side view of a third embodiment of a cleaner head according to the invention.

A similar arrangement is illustrated in FIG. 5. In this arrangement, the cleaner head 130 again includes a housing 132 having an upper surface 134, a lower surface 136 and a front surface 138. As before, a brush bar 140 is rotatably mounted on the upper surface 134 so as to be located in the suction opening 142. The housing 132 defines a suction passage 146 allowing dirt-laden air to be carried from the suction opening 142 to a hose 148. Wheels 150 are mounted on the housing 132.

As in the previous embodiment, a force-transmitting member 152 is provided for connection with the main body or motor casing of a vacuum cleaner. One end of the force-transmitting member 152 is pivotably connected to a rod 154 which, as before, is pivotably mounted on the lower surface 136 of the housing 132 by way of a pivotable connection 156. The upper end of rod 154 again passes through an aperture 158 in the upper surface 134 of the housing 132 and is biased into a central position by opposed compression springs 160 whose distal ends are seated against the wall 162 of a closed cover 164 forming part of the housing 132.

A bleed valve 166 is located in the front surface 138 of the housing 132. The bleed valve 166 takes the form of a flap which is pivotably mounted on a support 168 extending inwardly from the front surface 138. The bleed valve 166 extends upwardly beyond the support 168 and the upper end of the bleed valve 166 is pivotably connected to a second rod 170 which, in turn, is pivotably connected to the rod 154. The connection of the rod 170 to the rod 154 is coincident with the connection of the force-transmitting member 152 to the rod 154.

The bleed valve 166 also extends downwardly past the support 168 as far as the lower edge of the front surface 138 which delimits the suction opening 142. This lower edge is formed integrally with the front surface 138. The bleed valve 166 is located in an opening, forming a bleed air inlet, formed in the front surface 138. The bleed air inlet extends across the majority of the front surface 138 of the cleaner head 130 so that large particles of dirt and/or debris can be sucked into the suction passage 146 through the bleed air inlet if required.

It will be appreciated that, if a force is applied to the force-transmitting member 152, then relative movement will occur between the force-transmitting member 152 and the housing 132. This movement will cause the rod 154 to be rotated about the connection 156 against the action of the compression springs 160. However, the movement of the rod 154 will cause movement of the rod 170 which, in turn, will cause rotation of the bleed valve 166 about its point of connection with the support 168. Movement of the force-transmitting member 152 to the right as illustrated in FIG. 5, will thus cause the bleed valve 166 to rotate in a clockwise direction, thus opening the bleed air inlet to allow air to be bled into the suction passage 146. Similarly, movement of the force-transmitting member 152 to the left as shown in FIG. 5 will cause the bleed valve 166 to be rotated in an anti-clockwise direction. The effect is similarly to allow air to be bled into the suction passage 146 through the bleed air inlet. It will be appreciated that the application of a force causing movement of the force-transmitting member 152 to the left represents a push-force urging the cleaner head 130 to be moved in a forwards direction and a force causing movement of the force-transmitting member to the right represents a pull-force urging the cleaner head to be moved rearwardly. Hence air can be bled into the cleaner head 130 irrespective of the desired direction of movement thereof.

As in the previous embodiment, it will be appreciated that physical movement of the cleaner head 130 across the surface to be cleaned is not required, in either direction, in order to achieve the introduction of bled air into the suction passage 146 in the event that the cleaner head becomes "stuck" to the surface to be cleaned.

Figure 6:
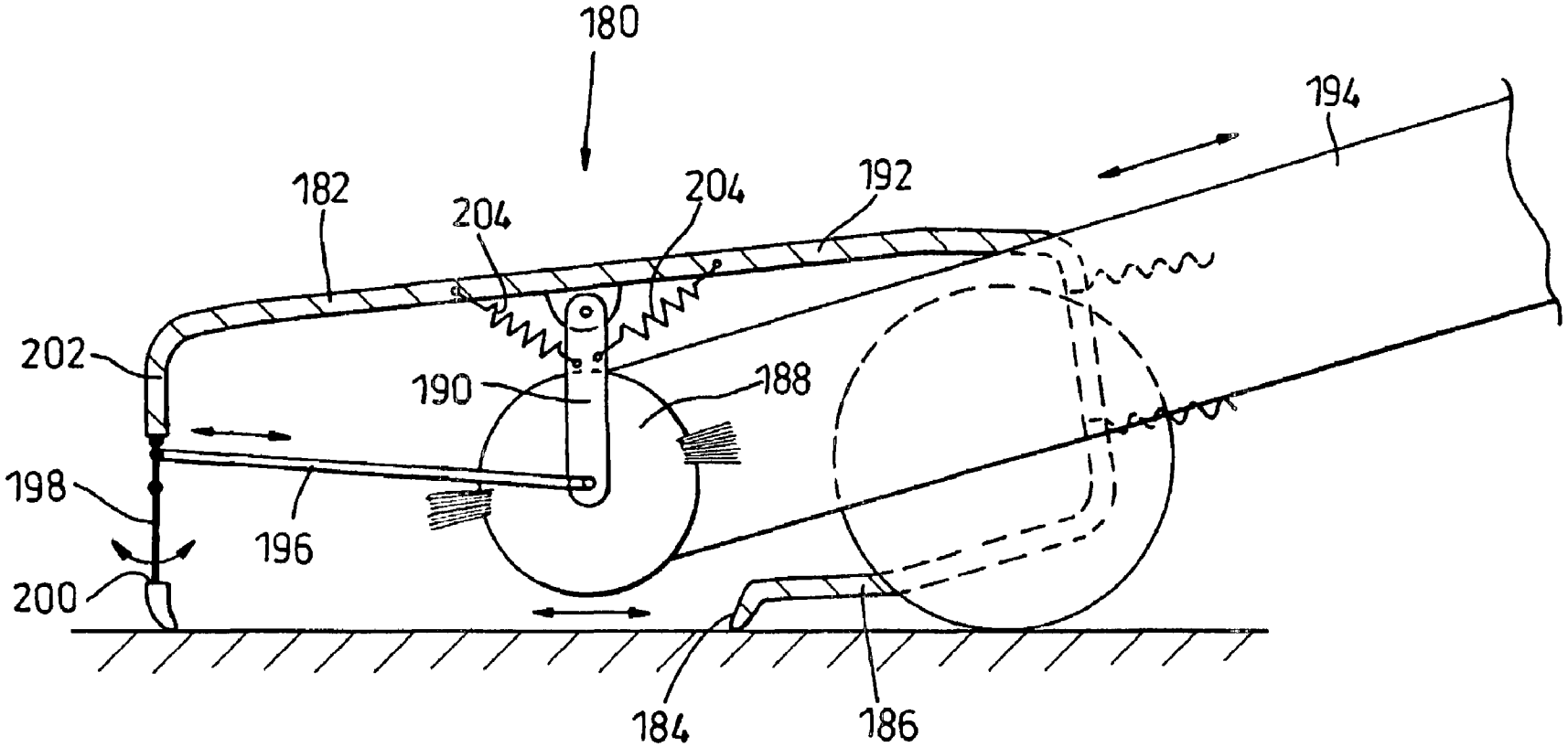
FIG. 6 is a schematic sectional side view of a fourth embodiment of a cleaner head according to the invention.

A further embodiment is illustrated in FIG. 6. Again, the cleaner head 180 has a housing 182 with a suction opening 184 being located in a lower surface of the housing 182. Many features of this embodiment are similar to those of previously described embodiments. However, in this case, the brush bar 188 is mounted in the suction opening via a support 190 which is pivotably mounted on the upper surface 192 of the housing 182. The force-transmitting member 194 is connected directly to the brush bar 188 and a rod 196 connects the brush bar 188 to the bleed valve 198. The bleed valve 198 is pivotably supported in the bleed air inlet 200 which is formed in the front surface 202 of the housing 182. The connection between the bleed valve 198 and the rod 196 is above the pivotable connection between the bleed valve 198 and the front surface 202. Tension springs 204 are provided between the support 190 and the upper surface 192 of the housing 182 so that the support 190 is biased into a generally central position. In this position, the bleed valve 198 essentially closes the bleed air inlet 200.

When the force-transmitting member 194 is moved with respect to the housing 182, the brush bar 188 is also moved with respect to the housing 182. The support 190 is rotated about its pivotable connection with the upper surface 192 against the action of the springs 204. The movement of the brush bar 188, and thus the rod 196, causes the bleed valve 198 to rotate about its pivotable connection with the front surface 202. When the force-transmitting member is moved to the left (as seen in FIG. 6), the bleed valve rotates in an anti-clockwise direction, thus allowing air to be bled through the bleed air inlet 200 into the suction passage. Similarly, movement of the force-transmitting member 194 to the right causes rotation of the bleed valve 198 in a clockwise direction. Again, air is bled into the cleaner head 180 through the bleed air inlet 200. Thus, air is bled into the cleaner head 180 when the force required to move the cleaner head 180 across the surface to be cleaned is high, irrespective of the intended direction of movement of the cleaner head. Furthermore, by increasing the force applied to the force-transmitting member 194, the bleed valve can be opened to a greater extent, thus allowing further air to be bled into the cleaner head 180. The greater the amount of air bled into the cleaner head 180 via the bleed air inlet 200, the lower the amount of suction developed at the suction opening 184. Thus, as the amount of air bled into the cleaner head 180 is increased, so the amount of force causing the cleaner head to become "stuck" to the surface to be cleaned is reduced.

Figure 7:
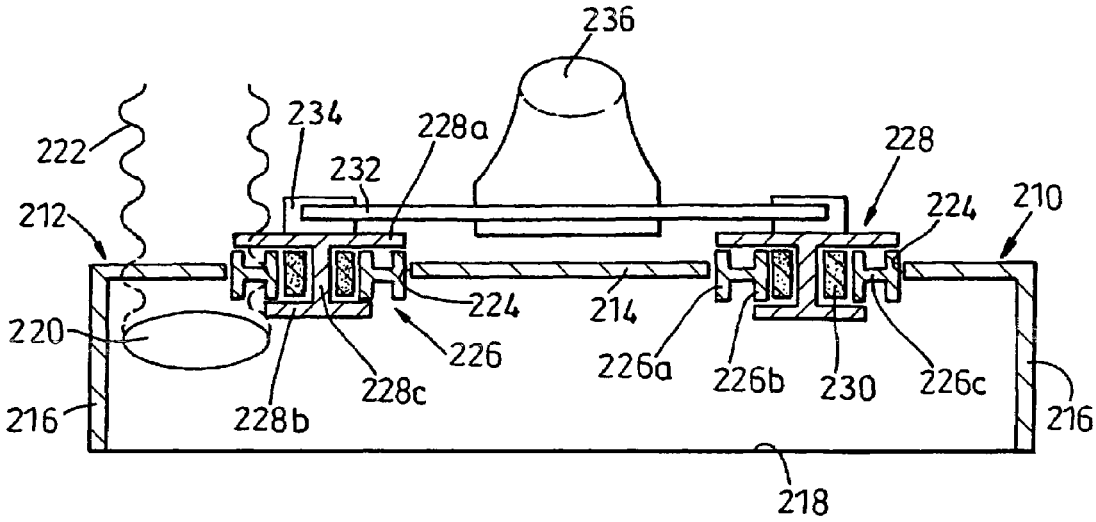
FIG. 7 is a schematic sectional view through a fifth embodiment of a cleaner head according to the invention.

A further embodiment is illustrated in FIG. 7, which shows a schematic cross-section of a cleaner head according to the invention. The cleaner head 210 comprises a housing 212 having an upper surface 214 and side walls 216. A suction opening 218 is arranged in the housing so as to face the surface to be cleaned. An aperture 220 is arranged in the housing 212 and a flexible conduit 222 is connected thereto externally of the housing 212. The interior of the housing 212, the aperture 220 and the conduit 222 together define a passage for carrying dirty air from the suction opening 218 to a distal end of the conduit 222, the distal end of the conduit 222 defining an outlet of the cleaner head 210.

Located in the upper surface 214 of the housing 212 are two spaced-apart apertures 224 which together form a bleed air inlet. Located in each of the apertures 224 is a support collar

226 comprising an outer sleeve 226*a* and an inner sleeve 226*b* supported thereon by means of circumferentially spaced spokes 226*c*. The outer sleeve 226*a* abuts tightly against the periphery of the aperture 224 in which the respective support collar 226 is located. The inner sleeve 226*b* is positioned coaxially with the outer sleeve 226*a* in the embodiment shown, although this is not essential. Also in the embodiment shown, four spokes 226*c* are equi-angularly arranged between the outer and inner sleeves 226*a*, 226*b* although a different number of spokes can be provided.

A bleed valve 228 is provided in association with each of the apertures 224 and support collars 226. Each bleed valve 228 comprises an upper member 228*a* and a lower member 228*b* held in a fixed, spaced-apart relationship by a connecting member 228*c*. The upper and lower members 228*a*, 228*b* are circular in shape, with the diameter of the upper member 228*a* being similar to that of the outer sleeve 226*a* and the diameter of the lower member 228*b* being similar to that of the inner sleeve 226*b*. The length of the connecting member 228*c* is chosen so that, when the lower surface of the upper member 228*a* rests on the upper end of the outer collar 226*a*, the upper surface of the lower member 228*b* is held against the lower end of the inner sleeve 226*b*, although relative movement between the support collar 226 and the bleed valve 228 is still permitted.

The diameter of the connecting member 228*c* is significantly smaller than that of the inner sleeve 226*c*. A resilient body 230 occupies the space between the inner sleeve 226*b* and the connecting member 228*c*. The resilient body 230 is generally cylindrical in shape with a central passageway formed therein, the connecting member 228*c* passing through the resilient member 230 along the passageway.

A transverse rod 232 extends between the two bleed valves 228 and is connected thereto by means of mounting blocks 234 affixed to the upper members 228*a* of each of the bleed valves 228. A connector 236 is fixed to the transverse rod 232 and provides a means for connecting the cleaner head 210 to the main body of a vacuum cleaner. In the case of a cylinder vacuum cleaner, the connector 236 will receive or be received by the distal end of a hose and wand assembly as has been described above. In the case of an upright vacuum cleaner, the connector 236 will be connected to the main casing or motor housing, either permanently or releasably.

The transverse rod 232, either alone or in combination with the connector 236, acts as a force-transmitting member by means of which forces applied by the user to move the cleaner head 210 across the surface to be cleaned are transmitted to the cleaner head 210. As can be seen from FIG. 7, the force-transmitting member 232, 234 is connected to the housing via the bleed valves 228. Therefore, when the force required to move the cleaner head 210 across the surface to be cleaned exceeds the force required to compress the resilient body 230, the bleed valves 228 will be moved with respect to the housing 210, more specifically, with respect to the support collars 226. As soon as the bleed valves 228 are displaced significantly from the position shown in FIG. 7, the upper members 228*a* cease to close the channel between the outer and inner sleeves 226*a*, 226*b* and allow air to be sucked into the interior of the housing 212 therealong. This reduces the suction developed at the suction opening 218 and allows the cleaner head 210 to be moved across the surface to be cleaned without requiring excessive forces to be applied. Furthermore, the bleeding of additional air into the cleaner head 210 assists in maintaining the efficiency of the vacuum cleaner by maintaining the volume of air available to transport dirt and dust from the cleaner head 210 to the separation apparatus.

FIG. 8*a*, 8*b*, 8*c* and 8*d* illustrate the movement of the bleed valves 228 when forces are applied to the force-transmitting member 232 in different directions. In each case, the left-hand side of the Figure shows the position of the upper member 228*a* of the bleed valve 228 and the right-hand side of the Figure shows the position of the connecting member 228*c*, the resilient body 230 and the lower member 228*c*, all with respect to the support collars 226.

Figure 8A:
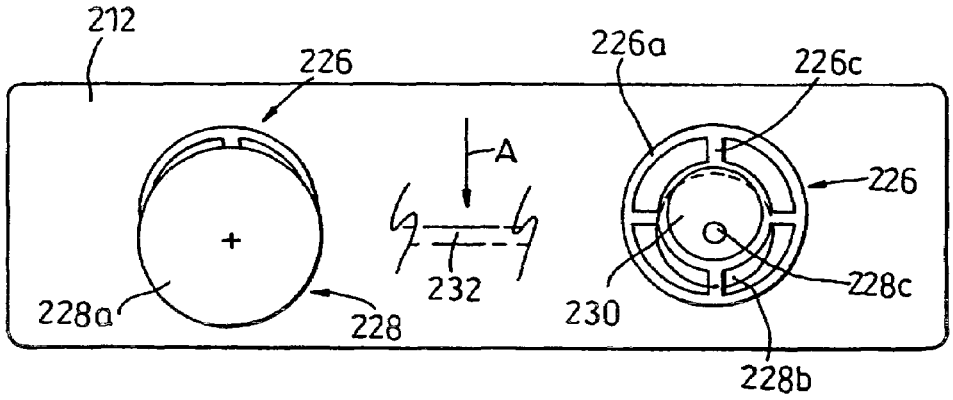
FIGS. 8*a* to 8*d* are schematic top views of the cleaner head of FIG. 7 illustrating different positions thereof.

Looking firstly at FIG. 8*a*, the force applied to the force-transmitting member 232 is shown by arrow A. The upper member 228*a*, together with the connecting member 228*c* and the lower member 228*b* are displaced in the same direction, thereby compressing the resilient body 230. A portion of the channel between the outer sleeve 226*a* and the inner sleeve 226*b* is thus opened to atmosphere and ambient air is allowed to enter the housing 212. This illustration is intended to represent the situation in which the cleaner head 210 is moved over the surface to be cleaned in a forwards direction.

Figure 8B:
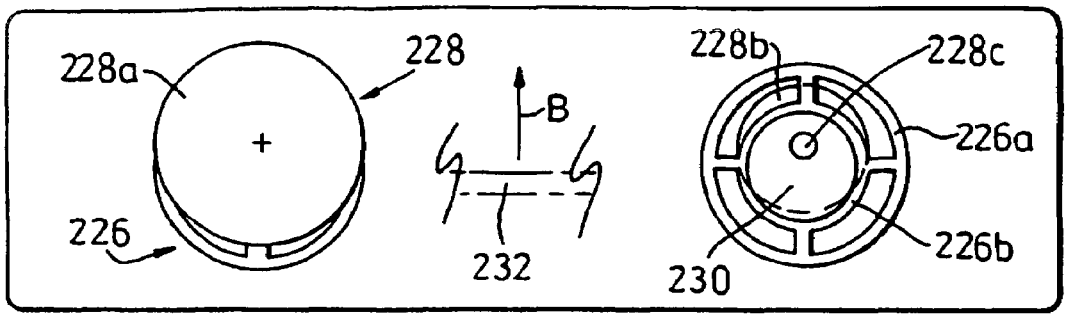

In a very similar manner, when a force intended to move the cleaner head rearwardly is applied, the direction of the applied force is as shown by arrow B in FIG. 8*b*. The upper member 226*a* is moved, together with the connecting member 226*c* and the lower member 226*b*, away from the central "rest" position against the biasing action of the resilient body 230 as shown. In both cases, when the force applied to the force-transmitting member 232 is released (or reduced to a level which cannot overcome the biasing action of the resilient body), the bleed valves 228 return to the position shown in FIG. 7. Equally, if the amount of air bled into the housing 212 as a result of the displacement of the bleed valves 228 is insufficient to reduce the suction developed at the suction opening to an acceptable level, the force applied to the force-transmitting member 232 can be increased so as to compress the resilient body 230 further, thereby increasing the area of the channel between the outer sleeve 226*a* and the inner sleeve 228*b* through which air can be bled. This allows a greater volume of air to be bled into the housing 212 further reducing the suction developed at the suction opening 218.

Figure 8C:
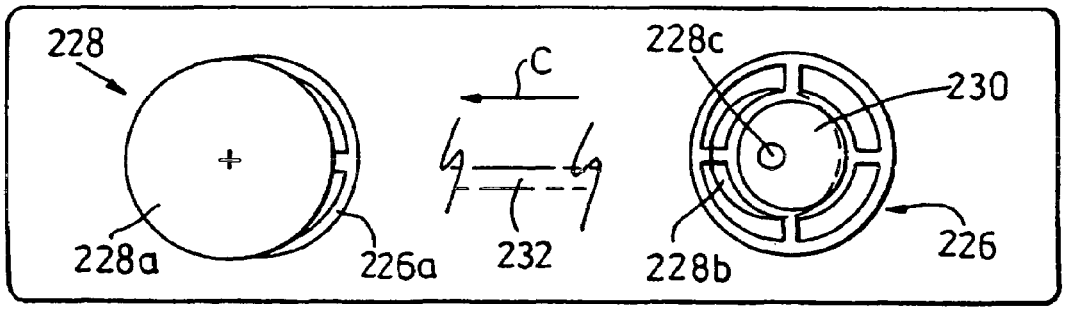

The arrangement described above is equally effective when transverse forces are applied to the force-transmitting member 232. FIG. 8*c* illustrates the position when the force is applied in the direction of arrow C. Again, the displacement of the upper members 228*a* of the bleed valves 228 allows air to be bled into the housing 212 via the channel formed between the outer sleeve 226*a* and the inner sleeve 226*b*. It will be appreciated that the application of a force in the opposite transverse direction will displace the bleed valves 228 in a direction opposite to that shown in FIG. 8*c*.

Figure 8D:
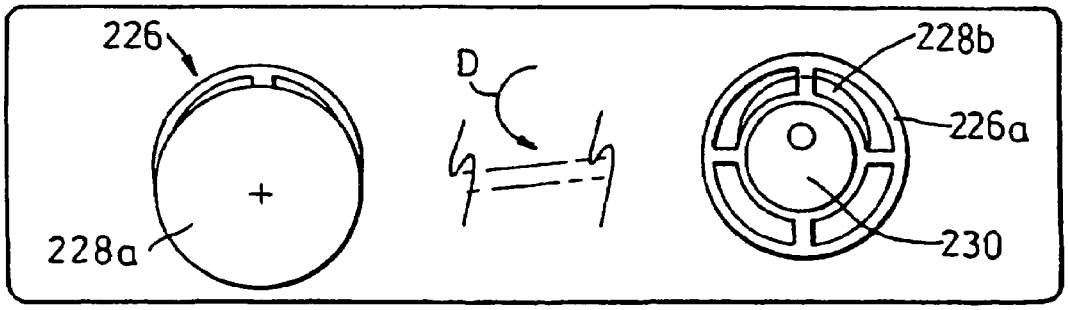

Lastly, if the force-transmitting member is subjected to a twisting force such as that shown by arrow D in FIG. 8*d*, the displacement of the bleed valves 228 will be as shown in FIG. 8*d*. More specifically, one of the bleed valves 228 will be displaced in a first direction and the other bleed valve 228 will be displaced in the opposite direction. Nevertheless, the effect achieved will be the same as in the other situations described above.

It will be appreciated that the precise details of the shape and configuration of the cleaner head, its means of support and manoeuvrability over a surface to be cleaned, and its precise means of connection to the respective vacuum cleaner are immaterial to the present invention. The essential element of the invention is the provision of a member capable of relative movement with respect to the cleaner head so that, if the cleaner head becomes "stuck" to the surface to be cleaned, relative movement can take place. This relative movement is then utilised to activate a bleed valve to allow air to be bled into the cleaner head so as to reduce the amount of suction developed at the suction opening. This reduction in the suction developed at the suction opening reduces the amount of effort required to be applied by the user in order to manoeuvre the vacuum cleaner over the surface to be cleaned. The result is a vacuum cleaner which has enhanced manoeuvrability for the user.

The invention claimed is:

1. A cleaner head for a vacuum cleaner comprising a housing, a suction opening in a face of the housing which is intended to face a floor surface, a suction passage for conducting dirt-laden air from the suction opening through the cleaner head to an outlet thereof, a bleed air inlet arranged in the housing and closed by a bleed valve which is openable to allow air to be bled into the suction passage via the bleed air inlet, the cleaner head further comprising a force-transmitting member connected to, or adapted to be connected to, a handle by means of which the cleaner head is, in use, maneuvered across the floor surface, the force-transmitting member being connected to the housing by a connection allowing relative movement between the force-transmitting member and the housing, wherein the bleed valve is adapted to open in response to the amount of force required to move the cleaner head across the floor surface irrespective of the direction of movement of the cleaner head.

2. A cleaner head as claimed in claim 1, wherein the bleed valve is adapted to open in response to the amount of relative movement between the force-transmitting member and the housing.

3. A cleaner head as claimed in claim 2, wherein the bleed valve is adapted to open when the amount of relative movement between the force-transmitting member and the housing exceeds a predetermined value.

4. A cleaner head as claimed in claim 2 or 3, wherein the bleed valve is adapted to open by an amount which is dependent upon the amount of relative movement between the force-transmitting member and the housing.

5. A cleaner head as claimed in claim 4, wherein the bleed valve is adapted to open by an amount which is proportional to the amount of relative movement between the force-transmitting member and the housing.

6. A cleaner head as claimed in claim 1, wherein the connection between the force-transmitting member and the housing comprises a resilient component which urges the force-transmitting member into a position relative to the housing in which the bleed air inlet is closed by the bleed valve.

7. A cleaner head as claimed in claim 6, wherein the resilient component is a spring.

8. A cleaner head as claimed in claim 6, wherein the resilient component is an elastic sleeve.

9. A cleaner head as claimed in claim 1, wherein the amount of air bled into the suction passage is the same when a particular force is required to move the cleaner head across the floor surface in either a forward direction or a rearward direction.

10. A cleaner head as claimed in claim 1, wherein the amount of air bled into the suction passage is the same when a particular force is required to move the cleaner head across the floor surface in either a first sideways direction or an opposite sideways direction.

11. A cleaner head as claimed in claim 1, wherein the amount of air bled into the suction passage is the same when a particular force is required to move the cleaner head across the floor surface in either a first twisting direction or an opposite twisting direction.

12. A cleaner head as claimed claim 1, wherein the bleed air inlet is located on a face of the housing which is not intended to face the floor surface.

13. A cleaner head as claimed in claim 12, wherein the bleed air inlet is located on a forward facing surface of the housing.

14. A cleaner head as claimed in claim 13, wherein the bleed air inlet is located centrally of the forward facing surface of the housing and adjacent the face of the housing which is intended to face the floor surface.

15. A cleaner head as claimed in claim 12, wherein the bleed air inlet is located on an upper surface of the housing.

16. A cleaner head as claimed in claim 1, wherein the bleed valve comprises a pivotably mounted closure member.

17. A cleaner head as claimed in claim 16, wherein the closure member is pivoted in a first direction when, in use, the cleaner head is moved across the floor in a forward direction and in a second direction when, in use, the cleaner head is moved across the floor in a rearward direction.

18. A cleaner head as claimed in claim 1, wherein the bleed valve comprises a plurality of closure members movable with respect to the bleed air inlet.

19. A cleaner head as claimed in claim 1, wherein a rotatable brush bar is provided in the suction opening for agitating a floor covering to be cleaned.

20. A cleaner head as claimed in claim 19, wherein the rotatable brush bar is mounted on the housing.

21. A cleaner head as claimed in claim 19, wherein the rotatable brush bar is mounted on the force-transmitting member.

22. A vacuum cleaner incorporating a cleaner head as claimed in claim 1.

* * * * *